US008128314B2

(12) United States Patent
Buschmann et al.

(10) Patent No.: US 8,128,314 B2
(45) Date of Patent: Mar. 6, 2012

(54) PAVING SCREED AND A METHOD FOR LAYING A PAVING MAT

(75) Inventors: Martin Buschmann, Neustadt (DE); Roman Munz, Neustadt (DE)

(73) Assignee: Joseph Vögele AG, Ludwigshafen (DE)

( * ) Notice: Subject to any disclaimer, the term of this patent is extended or adjusted under 35 U.S.C. 154(b) by 194 days.

(21) Appl. No.: 12/616,813

(22) Filed: Nov. 12, 2009

(65) Prior Publication Data

US 2010/0150651 A1 Jun. 17, 2010

(30) Foreign Application Priority Data

Dec. 16, 2008 (EP) ..... 08021844

(51) Int. Cl.
*E01C 19/22* (2006.01)

(52) U.S. Cl. ..... 404/118; 404/104

(58) Field of Classification Search ..... 404/83–105
See application file for complete search history.

(56) References Cited

U.S. PATENT DOCUMENTS 592,489 A 10/1897 Fair
(Continued)

FOREIGN PATENT DOCUMENTS

CH 488863 A 4/1970
(Continued)

*Primary Examiner* — Raymond W Addie
(74) *Attorney, Agent, or Firm* — Fish & Richardson P.C.

(57) ABSTRACT

A paving screed comprises a base screed and extension screeds each of which is support via an extension guiding structure at a guidance fixed in the base screed such that each extension screed can be extended and retracted. A multiple point suspension is provided between the extension guiding structure and the guidance. A frame carrying the sole plate of the extension screed A is arranged below the extension guiding structure. Substantially vertical adjustment assemblies make it possible to adjust the height position of the frame via drives. A lateral inclination adjustment assembly is provided structurally separated from the adjustment assemblies either for the frame or within the frame for the sole plate of the extension screed.

15 Claims, 8 Drawing Sheets

U.S. PATENT DOCUMENTS

| | | | | |
|---|---|---|---|---|
| 4,379,653 | A | 4/1983 | Brown | |
| 4,682,908 | A * | 7/1987 | Domenighetti | 404/84.1 |
| 5,568,992 | A | 10/1996 | Grembowicz et al. | |
| 6,056,474 | A * | 5/2000 | Nolan | 404/118 |
| 6,179,520 | B1 * | 1/2001 | Cochran | 404/114 |
| 6,273,636 | B1 * | 8/2001 | Johanpeter | 404/104 |
| RE39,834 | E * | 9/2007 | Kieranen et al. | 404/84.5 |
| 7,651,295 | B2 * | 1/2010 | Eppes et al. | 404/84.05 |
| 7,909,534 | B1 * | 3/2011 | Comer et al. | 404/118 |
| 2007/0258769 | A1 | 11/2007 | Eppes | |
| 2010/0150650 | A1 * | 6/2010 | Buschmann et al. | 404/82 |

FOREIGN PATENT DOCUMENTS

| | | | |
|---|---|---|---|
| DE | 2709435 | A1 | 9/1978 |
| EP | 1031660 | A1 | 8/2000 |
| WO | 2004081287 | A1 | 9/2004 |

* cited by examiner

G2
G
E
G1
F2
F
P1
P3
11
(P2)
8
16
K
F3
23
C
46
Z
A
A1
10
29
P1
40
33
3
30
20
Q
22
37
2
2E
35
47
31
38
19,19'
12
12'
15
16R
17R
14
13
M
7
P
43
1E
1
45
44
24
42
A2
X
21
17
17'
P2
18

PAVING SCREED AND A METHOD FOR LAYING A PAVING MAT

This application claims the priority of European Application EP08021844.9 filed Dec. 16, 2008, which is incorporated herein by reference in its entirety.

The invention relates to a paving screed and to a method for carrying a paving mat of variable working width.

More precisely the invention relates to a road paver paving screed, comprising: a base screed and extension screeds respectively supported by guiding assemblies in an extension guiding structure at a guidance fixed at the base screed, which extension screeds are arranged at the front side or the rear side of the base screed and are retractable and extendable in a sliding direction by means of drives relative to the base screed for varying the working width of the paving screed, sole plates respectively arranged at the lower sides of the base screed and of the extension screeds, connections arranged at the base screed for towing bars for floatingly towing the paving screed with an angle of attack of the sole plates relative to a planum, a respective multiple point suspension provided at the guiding assemblies between the extension guiding structure and the base screed, a frame in the extension screed, the frame carrying the sole plate of the extension screed, and at least two substantially vertical adjustment assemblies, which are spaced apart in the sliding direction of the respective extension screed, the adjustment assemblies engaging at the extension guiding structure at least for adjusting the height position of the frame relative to the base screed via at least one drive, a lateral inclination adjustment assembly having at least one remotely controlled drive, the lateral inclination adjustment assembly being structurally separated from the adjustment assemblies for adjusting a slope inclination angle at the sole plate of the extension screed relative to the base screed about a pivot hinge having a hinge axis oriented at least substantially perpendicular to the sliding direction and parallel to the sole plate of the extension screed.

Furthermore, the invention relates to a method for laying a paving mat of variable working width on a planum and comprising a lane and at least one laterally inclined, sideward slope with a paving screed comprising a base screed having a sole plate and at the front side or the rear side of the base screed at least one extension screed having a sole plate arranged at a frame for forming the slope outside of a transition from the lane into the slope, the extension screed being retractable and extendable laterally relative to the base screed for varying the working width, the extension screed being retractable and extendable together with an extension guiding structure at a base screed guidance having several guiding assemblies, at least two adjustment assemblies spaced apart in sliding direction and engaging at the extension guiding structure for adjusting the height position of the sole plate of the extension screed relative to the sole plate of the base screed, and a lateral inclination adjustment assembly being structurally and functionally separated from the adjustment assemblies for adjusting in the extension screed a lateral inclination angle of the sole plate of the extension screed in relation to the base screed for forming the slope, the method comprising the steps of towing the paving screed on the paving material, varying the working width and adapting at least the height position of the extension screed sole plate relative to the base screed sole plate corresponding to a variation of the working width.

During the production of a paving mat which is laterally continuous over the working width the working width is varied by extending or retracting the extension screeds relative to the base screed. A variation of the angle of attack of the floatingly towed paving screed (e.g. according to U.S. Pat. No. 4,379,653 A or DE-C-27 09 435) relative to the planum, which angle of attack influences the thickness of the paving mat, needs to adapt the height position of the rear edge of the respective sole plate of an extension screed relative to the rear edge of the sole plate of the base screed. This is executed by actuating the adjustment assemblies. A laterally varying thickness of the paving mat is achieved by adjusting different height positions of the towing points of the towing bars of the paving screed at the road paver. In this case, unavoidably, the base screed undergoes significant torsion. Despite the torsion of the base screed it has to be assured that the extension screeds can be uniformly retracted and extended for varying the working width. In addition, dragging forces and friction forces caused by the paving material then act on each extension screed sole plate, an edger plate and/or a screed extension part mounted at the outer end of the extension screed. These additional forces and the torsion both hinder uniform extensions or retractions of the extension screed. Among others frequently paving mats are produced in Northern America which paving mats have a lane and at least one sideward downwardly inclined slope. In this case the sole plate of one extension screed is inclined laterally in the travelling direction. It is then important to maintain the transition between the lane and the slope in lateral direction stationary with respect to the base screed when the working width is varied.

The paving screed known from U.S. Pat. No. 4,379,653 A has in one embodiment (FIGS. 1 to 16) the adjustment assemblies for the height position of the sole plate of the extension screed and the lateral inclination adjustment assembly functionally combined and arranged between the extension guiding structure and a front wall of the base screed. The extension guiding structure is a dual tube guiding frame. In the embodiment of FIGS. 17 to 24, to the contrary, the adjustment assemblies provided for adjusting the height position of the sole plate of the extension screed relative to the base screed are functionally and structurally separated from the lateral inclination adjustment assembly. The lateral inclination adjustment assembly is provided between a mounting bracket arranged at the rear side of the front wall of the base screed and the front wall of the base screed. The extension guiding structure is a dual tube guiding frame anchored at the mounting bracket and abuts at the front side of the front wall of the base screed. The height position of the extension guiding structure is adjustable relative to the mounting bracket by means of scissor lever adjustment assemblies supported at the mounting bracket. The frame of the extension screed is fixedly mounted at the extension guiding structure. All weight forces of the extension screed and also the dragging resistance of the paving material are transmitted exclusively via the mounting bracket into the base screed, as the extension guiding structure is movably arranged in abutting relation at the front wall of the base screed. The extension screed is supported counter to the travelling direction only on two small ring surfaces at the front side of the front wall of the base screed. Unavoidable torsions of the extension screed caused by the towing bars, the dragging resistance and the weight forces tend to bend the long guiding rods received in the two guiding tubes of the extension guiding structure. This partly or totally hinders small and/or rapid and smooth extension or retraction movements of the extension screed. The loose arrangement of the extension screed at the front wall of the base screed with the front wall clamped between the mounting bracket and the extension guiding structure, furthermore, hinders precise and rapid adjustments of the height position of the sole plate of the extension screed during the retraction or extension of the extension screed, which adjustments would be needed to hold the transition between the planar lane and the slope stationary with respect to the base screed, because the width of the lane should not change when the working width is varied.

The adjustment assemblies in the extension screed of the paving screed known from DE-C-2709435 both serve to adjust the height position and the lateral inclination of the sole plate of the extension screed. Adjustments of the lateral inclination are carried out here for forming certain crown profiles on the surface of the paving mat. The adjustment assemblies may have the form of spindles or hydrocylinders and may be remotely controlled also depending on the angle of attack of the base screed. In order to assure in case of a torsion of the base screed and/or when the working forces are acting that the working width can be varied without jamming, the multiple point suspensions of both extension screeds are statically defined three point suspensions of the extension guiding structures which thus cannot jam while being extracted or retracted.

In the paving screed known from DE-U-92 11 854 the sole plates of the extension screeds are automatically adjusted relative to the base screed to the respectively needed height position corresponding to the respective angle of attack of the paving screed relative to the planum, such that the formation of longitudinal steps is prevented in the surface of laid paving mat. This is carried out by implementing a regulating process. The paving screed contains a three point suspension for the extension guiding structure at inner and outer cheeks of each extension screed, in order to allow to vary the working width without jamming of the extension screeds despite significant forces.

The paving screed known from CH-B-488863 has at least one extension screed at the base screed and allows among others to lay paving mats having a sideward downwardly inclined slope. The extension screed is pivoted at the guidance which is fixed at the base screed either about a pivot axis which is substantially parallel to the planum and extends in travelling direction, or the guidance itself is pivoted together with the extension screed about the pivot axis at the base screed. In the first case a variation of the working width automatically also changes the lateral position of the transition between the lane and the slope. This is a significant drawback because then the width of the lane also varies. In the second case the transition remains stationary with respect to the base screed when the working width is varied. However, for pivoting the guidance at the base screed very complicated structures are needed.

The paving screed known from U.S. Pat. No. 5,568,992 has extension screeds which are mounted via extension guiding structures at the rear side of the base screed at guidances which are fixed in the base screed. The paving screed can also be used for producing a paving mat having at least one sideward downwardly inclining slope. By use of the adjustment assemblies of each extension screed then both the height position of the sole plate of the extension screed and the lateral inclination are adjusted. For a height adaptation both adjustment assemblies are adjusted synchronously and for the same stroke. For adjusting a lateral inclination angle of the sole plate of the extension screed both adjustment assemblies are adjusted over different strokes. A regulating system, to which different relevant information e.g. from sensors is transmitted, automatically regulates the simultaneous actuation of both adjustment assemblies such that with a variation of the working width the vertical position of the extension screed is changed in response to the angle of attack of the base screed so that a certain alignment is maintained between the base screed and the extension screed while the transition between the lane and slope is maintained stationary with respect to the base screed.

WO-A-2004/081287 discloses a paving screed in which each extension guiding structure moves on four support points of two parallel guiding tubes. Due to unavoidable torsions of the base screed and of the high reaction forces caused by the paving material this four point suspension tends to jam when the working width is varied of the base screed and also in case of high reaction forces caused by the paving material.

The paving screed known from US-A-2007/0258769 has extension screeds mounted at guidances at the front side of the base screed. Each extension screed has two adjustment assemblies for both height adaptations of the sole plate of the extension screed and adjustments of the lateral inclination angle. Each extension screed is sub-divided like a telescope into two sections. When the sole plate of the extension screed is inclined laterally relative to the base screed the guidances are pivoted accordingly.

Further prior art is contained in U.S. Pat. No. 592,489.

Paving screeds having extension screeds should not exceed a certain transport width corresponding to the width of the base screed. Furthermore, it is desirable to achieve a maximum working width substantially corresponding to the twofold width of the base screed. For these reasons each extension screed of the paving screed known from EP-B-1031660 can be extracted for about the half width of the base screed which comprises two base screed halves. A guiding fixation which is fixed to one base screed half is arranged for the extension screed such that the guiding fixation extends from one base screed half beyond the middle of the base screed into the other base screed half. Thereby a guiding body connected to the extension screed can be slid beyond the middle of the base screed into the other base screed half, when the extension screed is going to be fully retracted. This does not only result in a maximum working width corresponding substantially with the twofold width of the base screed, but advantageously also allows to stably suspend the maximally extended extension screed. The multiple point suspension of the extension guiding structures is a three point suspension which cannot jam when the extension screed is retracted or extended despite torsions of the base screed and/or high acting reaction forces caused by the paving material.

It is an object of the invention to provide a structurally simple and robust paving screed for laying a paving mat even having a slope, and to provide a method which can be carried out with this paving screed, such that in the case of a variation of the working width the transition between the slope and the lane can be held stationary with respect to the base screeds in a simple fashion. In particular when forming the slope high working forces should neither influence the retraction or extension of the extension screed nor the quality of at least the surface of the laid paving mat.

This object is achieved by the invention described herein.

As both adjustment assemblies in the paving screed exclusively are used for the height adaptation of the sole plate of the extension screed, while the angle of the lateral inclination of the sole plate of the extension screed is adjusted structurally separate about the pivot hinge relative to the frame or at the frame, for both functions simple and reliable adjustment assemblies and driving systems and control systems may be used. The structurally and functionally separated lateral inclination adjustment assembly also can be constructed simply and stably. The control for actuating the adjustment assemblies and/or the lateral inclination adjustment assembly can be simple when these assemblies are actuated separately. In particular, the adjustment assemblies can be actuated relatively rapidly in order to maintain the lateral position between the lane and the slope with respect to the base screed relatively precisely stationary when the working width is varied. As the adjustment assemblies only carry out height adjustments, and as the lateral inclination adjustment assembly only sets the lateral inclination, the respective adjustment processes may be coordinated relatively simply. As the adjustment assemblies are arranged between the extension guiding structure and the lateral inclination adjustment assembly facing the sole plate of the extension screed, the extension guiding structure is retracted and extracted in a sliding direction which is fixed with respect to the base screed. During movements the extension guiding structure is stably suspended in the multiple point suspension such that the extension guiding structure does not jam. All weight forces and also the dragging resistance of the paving material are transmitted via the extension guiding structure into the base screed, such that the lateral inclination adjustment assembly at least partially remains free from such forces. The lateral inclination of the adjustment assembly is functionally acting independently of the transmission of these forces into the base screed exclusively between the adjustment assemblies and either the sole plate of the extension screed or the frame carrying the sole plate of the extension screed.

According to the method the lateral inclination angle of the sole plate of the extension screed is adjusted independently from the adjustment assemblies provided for height adaptations only. For each height adaptation operation both adjustment assemblies of the extension screed do not need to be actuated individually. The transition remains stationary by use of a simple control, and optionally by a common drive for the adjustment assemblies.

In an embodiment of the paving screed working forces of the paving material acting at the frame deviate the sole plate of the extension screed and are directly transmitted to the extension guiding structure via the adjustment assemblies and via optionally provided vertical guidances, such working forces may become relatively high in the case when a slope is formed. The inclined sole plate of the extension screed remains free of such high forces, resulting in a good surface quality of the paving mat in the region of the slope. The suspension and the adjustment of the inclination of the sole plate of the extension screed in the frame only need simple structures which operate with low wear.

Expediently, the lateral inclination adjustment assembly has the pivot hinge either at the frame or at an intermediate frame, and as a drive at least one actuator which is distant in sliding direction from the pivot hinge. For adjustments of the lateral inclination angle moderate forces will then suffice to achieve a well-defined pivot movement. An inclination angle which normally is only set once is maintained reliably during the laying of a paving mat. The adjustment assemblies are always actuated over the same strokes and thus withstand working forces better and therefore are apt to follow a retraction or extension of the extension screed rapidly enough in order to hold the lateral position of the transition stationary. The adjustment assemblies engage at the frame if the sole plate of the extension screed is inclined laterally relative to the frame, or engage at the intermediate frame if the frame carrying the sole plate is inclined laterally relative to the intermediate frame.

Expediently, the sole plate of the extension screed is a planar plate having a skirt which extends upwardly along one longitudinal front side of the plate. In order to relieve the sole plate of the extension screed as much as possible from dragging forces caused by the paving material during the laying of a paving mat, expediently a front wall is mounted at the frame at the front side of the frame, seen in travelling direction. The front wall extends from above downwardly in front of the skirt of the sole plate of the extension screed, which skirt is then hidden behind the front wall, such that a part of the working forces from the paving material acting at the front wall are directly transmitted into the frame. Furthermore, the front wall hinders that paving material forming a high heap floats over the skirt and contaminates the extension screed.

A carrying frame is arranged on the sole plate of the extension screed when the sole plate is to be inclined laterally relative to the frame. The carrying frame, preferably, can be removed. The carrying frame comprises parts of the pivot hinge and at least one support for the actuator. The frame, preferably, has an inverted U-shaped cross-section with an open lower side which is closed by the sole plate, and carries further parts of the pivot hinge and a support for the actuator. This is advantageous because the sole plate of the extension screed is a wear part that in this case can be exchanged easily. Furthermore, the carrying frame fitted from below into the frame stiffens the sole plate of the extension screed.

The hinge axis may be defined by at least one pin which is inserted into the aligned parts of the pivot hinge. The pin supports the sole plate of the extension screed stably and over a significant width at the frame or supports the frame in the same manner at the intermediate frame.

Expediently, a mounting plate is arranged at the outer end of the frame. The mounting plate serves to mount either an edger plate or a screed extension part for setting an even larger working width. Forces which result e.g. from the dragging resistance of a screed extension part or the edger plate in the paving material act in the frame and deviate the sole plate of the extension screed.

In an embodiment of the paving screed having the extensions screeds mounted to the front side or to the rear side of the base screed the lateral position of the pivot hinge can be selected arbitrarily. In each case it is of advantage if the actuator has a large distance in sliding direction from the pivot hinge. An extension screed mounted to the front side of the base screed is working in travelling direction ahead of the base screed. In this case there is no danger that paving material may accumulate in front of the base screed when a slope is formed. If the extension screeds are mounted at the rear side of the base screed, the actuator may, preferably, be arranged in an end region of the frame facing towards the middle of the base screed, while the pivot hinge may be arranged in the end region of the frame which is remote from the middle of the base screed. In this case the sole plate of the extension screed is pivoted at its end facing towards the base screed about the hinge axis which is placed as far as possible to the outer side. This assures that when forming a slope no triangular dead space will be formed in front of the extension screed where paving material could accumulate.

The actuator of the lateral inclination adjustment assembly is at least one hydrocylinder which is oriented substantially vertically or is a hydraulically or electrically driven spindle drive which e.g. by internal friction or hydraulic blockage safely holds the selected lateral inclination angle. In order to carry out a sensitive adjustment with moderate driving force the actuator may, preferably, be combined with an angular transmission or a worm drive converting the rotary motion of the actuator into the adjustment movement. For stability reasons even two actuators may be provided which are distant from each other in travelling direction.

As the working forces resulting from the paving material and acting mainly at the outer end of the frame may be markedly high, specifically when extension screed parts are mounted, it may be expedient to functionally associate vertical guidances to the adjustment assemblies. Universal joints may be provided between the vertical guidances and the frame. If the frame is not inclined laterally for adjusting the lateral inclination of the sole plate of the extension screed, the vertical guidances even could be connected rigidly with the frame. However, even then universal joints may be expedient when the frame is inclined laterally or is tilted, in order to adjust the angle of attack of the extension screed individually from the angle of attack of the base screed, as may sometimes be necessary.

In an expedient embodiment with the sole plate of the extension screed being inclined laterally relative to the frame the lower side of the frame and the upper side of the skirt of the sole plate of the extension screed should rise gradually in sliding direction towards the middle of the base screed. In this case, preferably, the inclination of the lower side of the frame may limit a maximum lateral inclination angle of about 10%. When the sole plate of the extension screed is then inclined laterally with the maximum lateral inclination angle, it comes to a mechanical stop and is supported stably.

As when laying a paying mat with a slope at least the base screed may undergo torsion due to different elevation settings of the towing points of the towing bars of the paving screed, and when relatively high working forces have to be expected, it may be expedient to design the multiple point suspension as a three point suspension which cannot jam even in case of torsion of the base screed. The extension guiding structure has a first support point at an outer cheek outside of the base screed at a telescope tube which is extendable and retractable in a telescopic tube arrangement of the guidance fixed in the base screed. The extension guiding structure has a displaceable second support point at an inner cheek within the base screed and on the telescope tube. Furthermore, a guiding rail is fixed at the rear side of the extension guiding structure. The guiding rail extends in sliding direction and engages slidably into a torque support fixed at the base screed. The torque support supports the guiding rail in both rotary directions about the axis of the guidance and such that the guiding contact between the torque support and the guiding rail defines a third support point. This three point suspension operates in the case of torsion of the base screed without jamming such that the working width can be varied as rapidly as needed and very uniformly. However, this type of the three point suspension dictates that each extension screed can be extended only with a stroke which does not correspond to the full half width of the base screed, such that the maximum working width does not correspond to the twofold width of the base screed. This also puts a limit on the width of the slope formed by the fully extended extension screed.

In order to allow to produce an optimum width of the slope and a maximum working width of the paving screed substantially corresponding to the twofold width of the base screed when both extension screeds are maximally extended, in a further expedient embodiment the multiple point suspension of the extension guiding structure also is a three point suspension operating in the case of torsion of the base screed without jamming. In this case the extension guiding structure has the first support point at an outer cheek outside of the base screed at a telescope tube which can be extracted and retracted in a telescopic tube arrangement of the guidance fixed at the base screed. An inner cheek of the extension guiding structure has a displaceable second support point in a guiding body on a guiding tube. The guiding tube is fixed in the base screed parallel to the guidance and with an offset in travelling direction. Furthermore, a guiding rail fixed at the rear side of the extension guiding structure and extending in sliding direction defines a third support point where it engages in a torque support fixed at the rear side of the base screed. The guiding tube is secured at an inner end in the base screed in a fixation which extends from the side of the extension screed beyond the middle to the other side of the base screed such that the guiding body defining the second support point may travel on the guiding tube beyond the middle of the base screed substantially towards the fixation when the extension screed is maximally retracted. This structure results in a maximum extension stroke of the extension screed corresponding to half of the width of the base screed, such that by using both extension screeds a working width can be set which corresponds substantially to the twofold width of the base screed. Even in the case of a torsion of the base screed and with exterior forces acting from the paving material a rapid variation of the working width is possible while at the same time, e.g. in co-action with the adjustment assemblies the transition into the slope is held stationary. Owing to the placement of the fixation securing the guiding tube in the respective other side of the base screed it may be expedient to place at least the two guiding tubes in the base screed with a lateral offset such that the fixations do not interfere with each other.

A further embodiment of the paving screed allowing a largely automatic or at least semi-automatic remote actuation of adjustment operations, or allowing comfortable adjustment operations executed by the operator of the road paver or by personnel, has a lateral inclination measurement device for measuring the lateral inclination of the sole plate of the extension screed and/or a height measuring device for measuring the relative height difference between the sole plate of the extension screed and the sole plate of the base screed and/or a linear travelling measuring device within or at the actuator the lateral inclination adjustment assembly, each connected in signal transmitting fashion with a superimposed control device. With the help of information on the actual conditions the extension screeds can be adjusted rapidly enough, such that irrespective of variations of the working width during laying of a paving mat with a slope the transition between the lane and slope will be held stationarily with respect to the base screed, or at least when drifting off is returned relatively rapidly to the desired lateral position.

In an embodiment of the paving screed in which the frame is inclined laterally together with the sole plate of the extension screed and relative to the intermediate frame, it may be expedient to arrange the adjustment assemblies at the intermediate frame in sliding direction of the extension screed between the pivot hinge and the actuator of the lateral inclination adjustment assembly. This structure results in an optimally large support length for the frame at the intermediate frame. Even a mounted screed extension part will also be inclined laterally so that a broader slope can be formed.

In order to hold the transition between the lane and the slope with respect to the base screed stationary when the working width is varied, remotely controlled adjustment assemblies are obligatory, such that the height adjustments can be carried out while the extension screed is retracted or extended. Each adjustment assembly may comprise at least one screw spindle device or a hydrocylinder and a drive. Expediently, even a common remotely controlled drive is associated to both adjustment assemblies of each extension screed. A common drive is structurally simple and assures the synchronous adjustment of both adjustment assemblies respectively over the same stroke. The drive may be a hydraulic or even an electric drive. Expediently, a chain drive or chain drives or transmission trains are provided between the respective drive or the common drive and the respective screw spindle device. The common drive could even engage at only one screw spindle device which then is coupled by a chain drive with the other screw spindle device in order to achieve synchronous adjustments of both screw spindle devices. In order to distribute loads uniformly occurring during rapid height adjustments, it may be expedient to provide in each screw spindle device of one adjustment assembly a pair of screw spindles and to drive the screw spindles of the pair synchronously. The respective vertical guidance expediently then may be arranged between both screw spindles of the pair. In this case both screw spindles may be arranged in travelling direction one behind the other.

According to the method it may be advantageous if a variation of the lateral inclination angle of the sole plate of the extension screed needed during the laying of a paving mat is executed exclusively by actuation of the lateral inclination adjustment assembly which is arranged in the frame, while at the same time the adjustment assemblies are actuated separately in order to hold the lateral position of the transition with respect to the sole plate of the base screed stationary.

A control routine or regulation routine may be implemented according to which the height adjustment speed of the adjustment assembly is correlated as a guiding parameter with the speed of the retraction or extension of the extension screed. This may mean that, e.g., the speed of the extension or retraction in sliding direction is matched with the adjustment speed of the height adjustment corresponding to the set lateral inclination angle.

BRIEF DESCRIPTION OF THE DRAWINGS

FIG. 1 schematically shows a road paver RF floatingly towing a paving screed E on a planum P while laying from poured paving material V in a travelling direction a paving mat 43, e.g. including a planar lane 45 and sideward downwardly inclined slope 44. The paving screed E comprises a base screed G having a sole plate 1 at the lower side. The sole plate 1 forms an angle of attack α relative to the planum P. The base screed G has a fixed guidance F at each side for at least one extension screed A which can be retracted and extracted perpendicular to the drawing plane in a sliding direction Z. A sole plate 2 is mounted at the lower side of the extension screed A. The paving screed E is coupled via towing bars 9 connected to the base screed G to towing points 5 of the road paver RF. The towing points 5 may be adjusted individually or commonly in the respective direction of a double arrow 6 upwardly and downwardly in order to set the angle of attack α or even to set the angle of attack α for both sides of the paving screed E differently. FIG. 1 shows two extension screeds A at the rear side of the base screed G. The extension screeds A are substantially symmetric. In a not shown alternative even a single extension screed A could be provided, or the respective extension screed A could be arranged at the front side of the base screed G.

Figure 1:
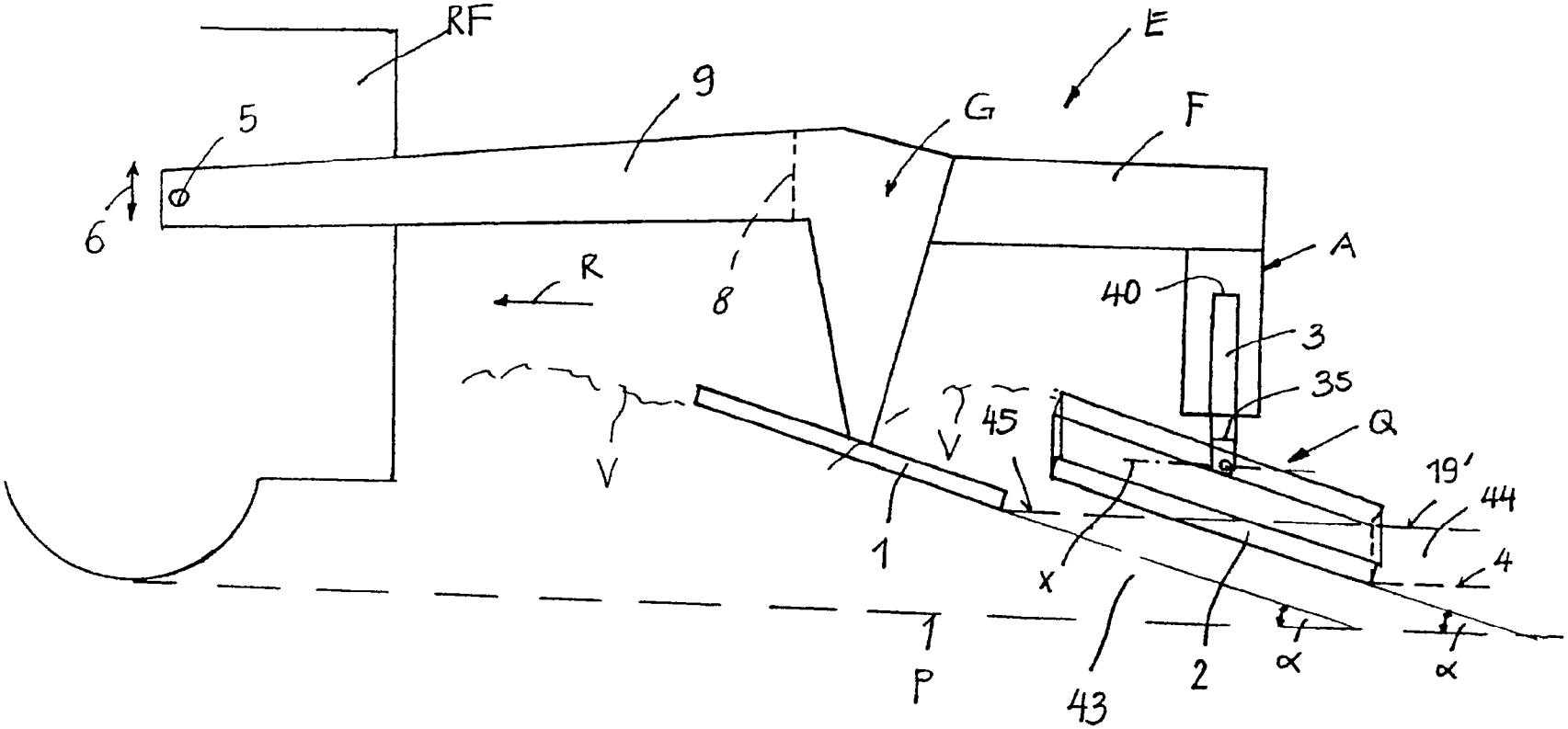
FIG. 1 is a schematic side view of a road paver having a floatingly towed paving screed while laying a paving mat.
Figure 2:
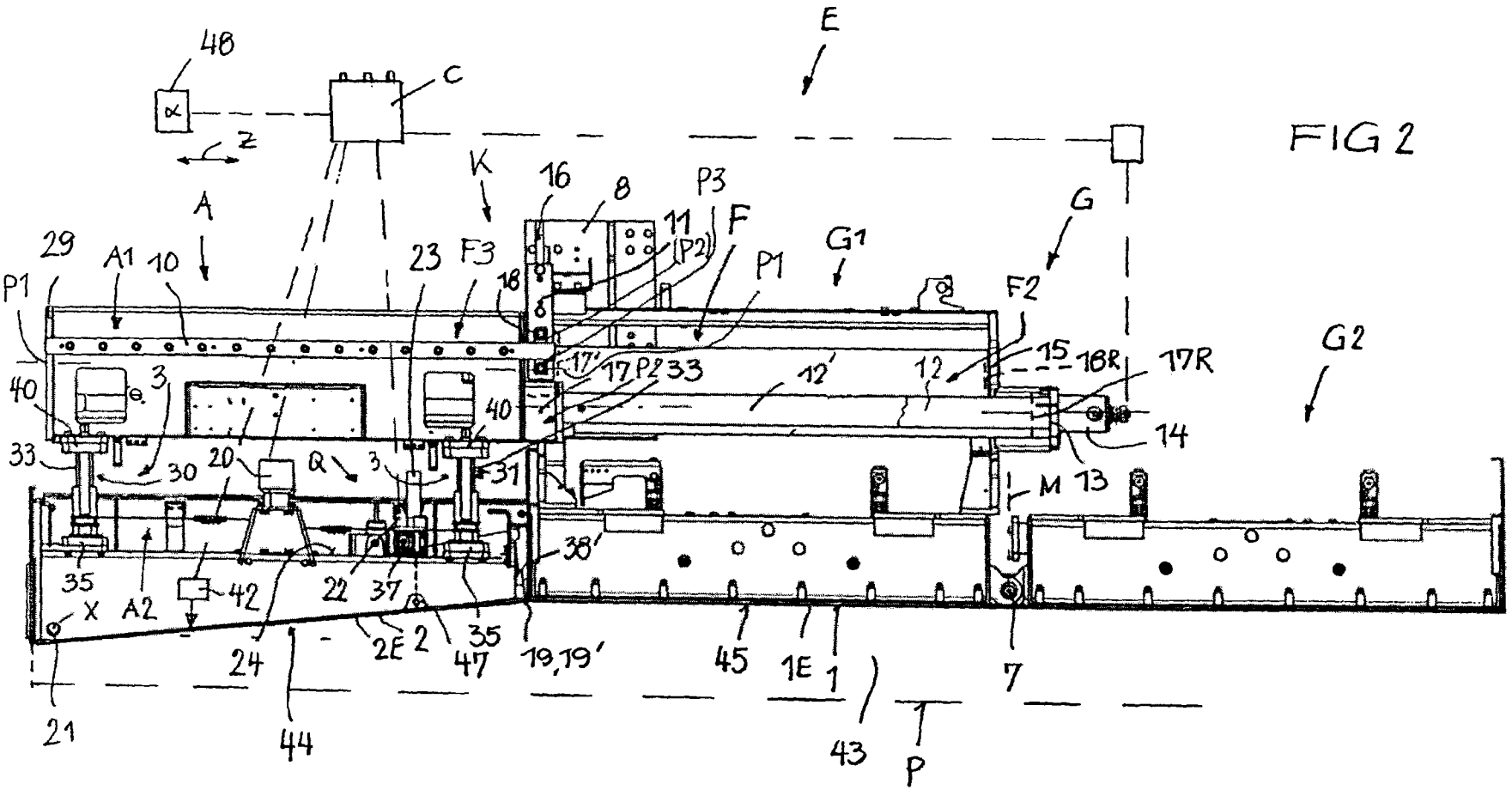
FIG. 2 is a rear view of a first embodiment of the paving screed showing substantially only one half of a base screed and a fully extended extension screed.

At least two adjustment assemblies 3 are arranged substantially vertical with a distance in-between in sliding direction Z between an extension guiding structure A1 at the guidance F which is fixed to the base screed G and the sole plate 2 of the extension screed A (FIG. 2). Furthermore, a separate lateral inclination adjustment assembly Q is provided between the adjustment assemblies 3 and the sole plate 2 of the extension screed A in order to incline the sole plate 2 of the extension screed A about a hinge axis X which e.g. is parallel to the planum P and extends in travelling direction R for forming the slope 44, as shown. The adjustment assemblies 3 serve to adjust the height position of the rear lower end point of the end edge of the sole plate 2 of the extension screed A which end point faces the base screed G depending on the magnitude of the angle of attack α to the height position of the lane 45. The lateral inclination adjustment assembly Q serves to adjust the inclination of the slope 44 relative to the lane 45 or a lateral inclination angle 39' of the sole plate 2 of the extension screed A so that the outer end point of the lower end edge of the sole plate 2 of the extension screed A has an elevation in a plane 4 corresponding to the outer edge of the slope 44. A transition 19' between the lane 45 and the slope 44 is defined in the surface of the paving mat 43 by the theoretical point of intersection 19 (inner view of the paving screed E from the rear, e.g. according to FIG. 2) between the sole plate 2 of the extension screed A and the sole plate 1 of the base screed G. The point of intersection 19 should be located in case of an extension screed A (FIG. 1) mounted at the rear side of the base screed G at the outermost end point of the rear edge of the sole plate 1 of the base screed G, and should be held stationary with respect of the base screed G when the working width is varied so that the width of the lane 45 is not unduly varied, but only the width of the slope 44.

When laying the paving mat 43 the paving material V, e.g. bituminous paving material or concrete paving material, is poured onto the planum P from the road paver RF in front of the paving screed E, is spread out laterally by a not shown lateral distribution device, and is levelled and compacted by the paving screed E which floats on the paving material V. Optionally, additional tampers, vibrators and/or pressing assemblies at or on the sole plates 1, 2 may level and compact the paving mat 43. The lane 45 formed by the base screed G is planar in lateral direction or has a crown profile. If the towing points 5 are set to different elevations (the thickness of the paving mat varies in lateral direction) the base screed G undergoes torsion via the fixedly connected towing bars 9 such that the angle of attack α varies in lateral direction.

Figure 3:
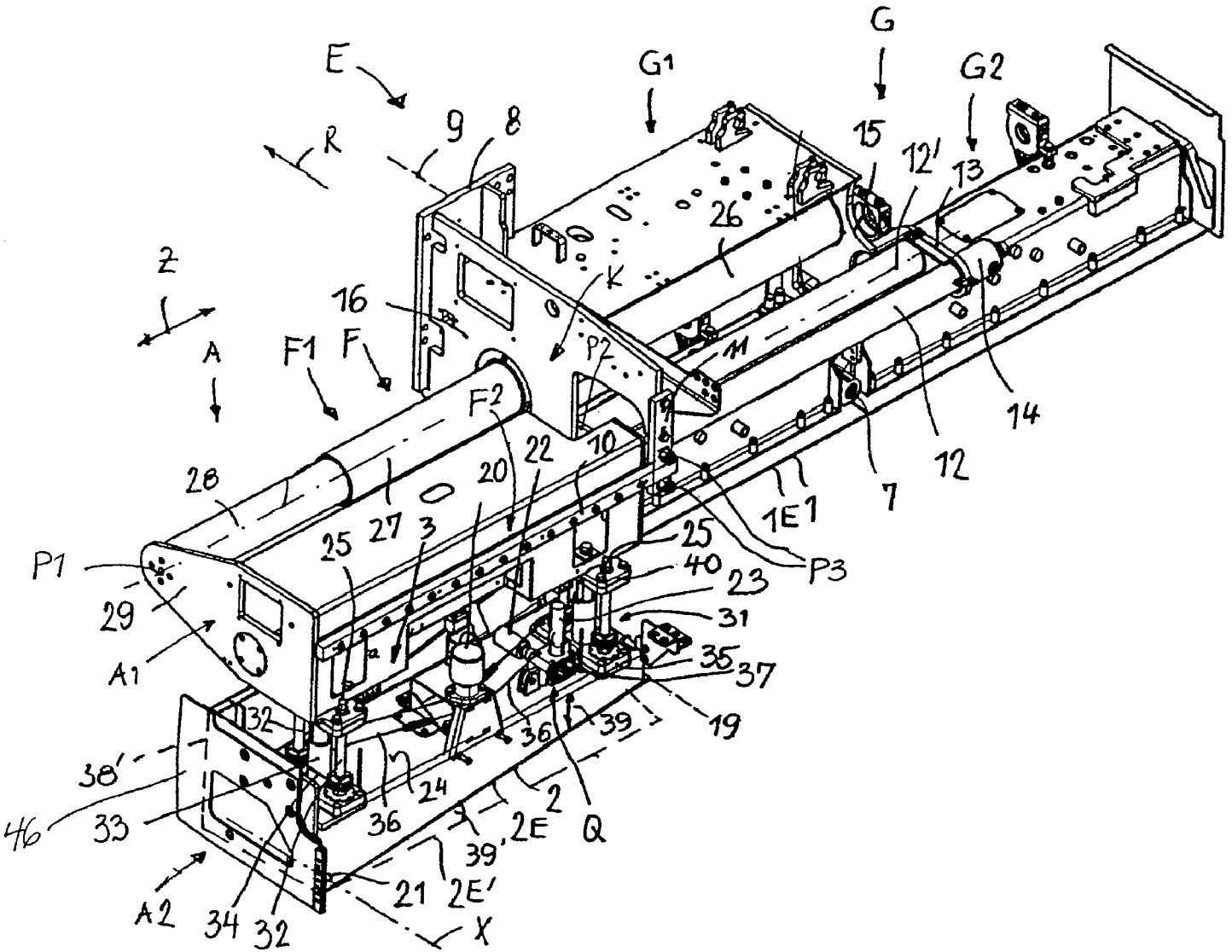
FIG. 3 is a perspective view from the left rear upper side of the paving screed shown in FIG. 2.
Figure 4:
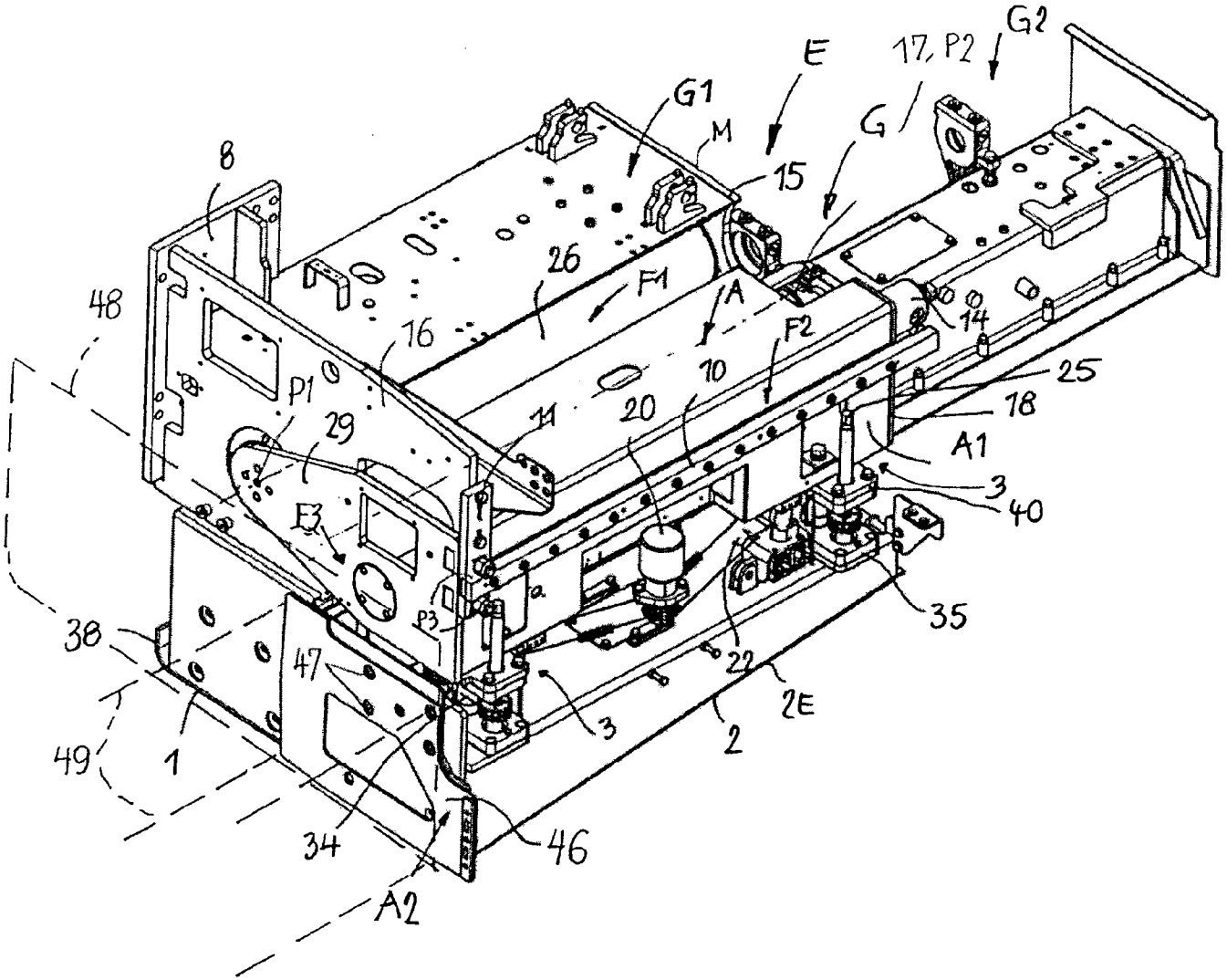
FIG. 4 is a perspective view from the rear left upper side of the paving screed of FIG. 2 with the extension screed fully retracted.

The base screed G may, according to FIGS. 2 to 4, comprise first and second base screed parts G1, G2 which are interconnected in the middle M of the base screed G in a joint 7 so that by means of a not shown adjustment device the base screed parts G1, G2 are either oriented parallel to each other (for a planar lane 45) or form an obtuse angle to each other (for a lane 45 having a crown profile). Each base screed part G1, G2 is a box-shaped construction with inner and outer cheeks 15, 16 and has a connection 8 for a towing bar 9.

The extension screed A can be slidably retracted or extended at the guidance F which is fixed in the base screed G via an extension guiding structure A1 by means of e.g. one drive 14 (e.g. a hydraulic cylinder) and parallel to the base screed G (sliding direction Z in FIG. 2). A multiple point suspension K is provided between the extension guiding structure A1 and the base screed G. The multiple point suspension K in FIG. 2 is a three point suspension which assures that the extension screed E will be retracted and extended without jamming even in case of torsion in the base screed G and/or while working forces are acting from the paving material V. The guidance F includes in the embodiment of FIGS. 2 to 4 three parallel guiding assemblies F1, F2, F3 which are, in a side view of the paving screed E, offset to each other and which take up during the laying process a torque resulting e.g. from the dragging resistance of the paving material V at the extension screed A to the base screed G.

The first guiding assembly F1 (FIG. 2, FIG. 3) includes e.g. a telescopic tube arrangement fixed between the inner and outer cheeks 15, 16 of the base screed part G1, the telescope tube comprising an outer tube 26, a slidable intermediate tube 27 and an innermost telescope tube 28. The telescopic tube 28 is fixed at an outer cheek 29 of the box-shaped extension guiding structure A1 (first support point P1).

The second guiding assembly F2 includes a guiding rod or a guiding tube 12' which is parallel to the telescopic tube arrangement in the base screed part G1 and is fixed between the cheeks 15, 16. The right side end of the guiding tube 12' in FIGS. 2 and 3 is secured in a fixation 13 connected to the cheek 15. The fixation 13, however, extends from the cheek 15 and from one side of the base screed G, i.e. from the base screed part G1, beyond the middle M into the other base screed part G2. A guiding body 17 is slidably guided on the guiding tube 12'. The guiding body 17 is secured at an inner cheek 18 of the extension guiding structure A1 and defines a second displaceable support point P2. The extension screed A (the width of which, seen in sliding direction Z, substantially corresponds to the width of the base screed part G1) is movable over a stroke substantially corresponding to the width of the base screed part G1. This is achieved in this embodiment because the guiding body 17 (second support point P2) can be brought beyond the middle M into a position 17R close to the fixation 13, when the extension screed A is fully retracted, such that then the inner cheek 18 of the extension guiding structure A1 comes into the dotted position 18R in FIG. 2. When the extension screed A is fully extended, the guiding body 17 is moved for at least the width of the base screed part G1 substantially into abutment at the outer cheek 16 (FIG. 2) of the base screed part G1. This results in the fully extracted position (FIG. 2) of the extension screed A in a stable suspension of the extension screed A at the base screed part G1, and in a minimum working width or transport width corresponding to the width of the base screed G in a fully retracted position. As long as two extension screeds A are provided, a maximum working width is achieved which is substantially equal to the twofold width of the base screed.

The third guiding assembly F3 includes in FIGS. 2 and 3 a guiding rail 10 and a torque support 11 for the guiding rail 10. The guiding rail 10 is mounted at the rear side of the extension guiding structure A1 and extends in sliding direction Z. The torque support 11 is mounted at the outer cheek 16 of the base screed part G1. The guiding rail 10 engages in the torque support 11 e.g. between rollers or sliding blocks. The guiding contact between the torque support 11 and the guiding rail 10 defines a third support point P3.

The three point suspension with the support points P1, P2, P3 assures that the extension screed A moves over the full stroke without any jamming.

In case of two extension screeds A, here arranged at the rear side of the base screed G, both extension guiding structures A1, and the guidances or guiding assemblies F1, F2, F3 are designed equally. However, the guiding assemblies F1, F2, F3 are offset to each other in the base screed parts G1, G2 in a side view of the paving screed E in order to prevent mutual collisions when both extension screeds A are fully retracted.

The most important advantage of the three point suspension of the extension guiding structure A1 is that in case of torsion of the base screed G and also in case of torques imparted by the paving material V on the extension screed A jamming do not occur such that the displacement drive 14, the cylinder tube 12 of which extends from the base screed part G1 beyond the middle M into the other base screed G2 may vary the working width rapidly and without jerks or blockages which otherwise would result in undesirable faults in the surface of the laid paving mat 43.

Another type of a three point suspension is also indicated in FIG. 2. In this case the guiding body 17' shown in dotted lines at the inner cheek 18 of the extension guiding structure A1 is directly guided in the interior of the base screed part G1 between the cheeks 15, 16 on the telescopic tube arrangement or the outer telescope tube 26 such that the second displaceable support point P2 is coaxial with the first support point P1. The third support point P3 of the extension guiding structure A1 again is defined in the torque support 11 at the check 16 of the base screed part G1 by the guiding contact of the guiding rail 10. However, in this case the displacement stroke of the guiding body 17' and, consequently, of the extension screed A, is limited by the distance between the cheeks 15, 16 of the base screed part G1, and hence is shorter than half of the width of the base screed G.

In each case the guiding body 17, 17' is connected such with the inner cheek 18 that it may travel through a cut-out portion in the outer cheek 16 of the base screed part G1, and such that the extension guiding structure A1 may move through this cut-out into the base screed part G1 until the outer cheek 29 abuts at the outer side of the outer cheek 16.

The two adjustment assemblies 3 provided per extension screed A include e.g. two screw spindle devices 30, 31 (FIG. 2) which are spaced apart in sliding direction Z. Each screw spindle device 30, 31 may comprise a mechanic actuation device 26 (as an option) which is accessible e.g. at an upper action end point 40. The upper action end point 40 e.g. may be a support console mounted at the lower side of the extension guiding structure A1. A lower action end point 35 of each adjustment assembly 3 may be defined by a console which is mounted on a substantially horizontal upper side 24 of a lower frame A2. The frame A2 is connected with the extension guiding structure A1 via the screw spindle devices 30, 31 and is additionally supported by vertical guidances 33 indicated in FIGS. 2 and 3, such that the frame is movable in vertical direction. In the embodiment shown each screw spindle device 30, 31 includes two screw spindles 32 between which a respective vertical guidance 33 is arranged. The vertical guidance 33 is connected at the upper and lower ends either rigidly or via universal joints with the extension guiding structure A1 and the lower frame A2 and e.g. is adjustable telescopically. Instead of the screw spindle devices 30, 31 hydraulic cylinders (not shown) could be provided.

In FIGS. 2 and 3 the screw spindles 32 of each screw spindle device 30, 31 are equipped e.g. with sprocket wheels which are coupled for a synchronous movement by an endless chain 34. A, preferably, common drive 20 is provided for both screw spindle devices 30, 31 at the extension guiding structure A1, e.g. an electric motor or a hydraulic motor adjusting both screw spindle devices 30, 31 synchronously and respectively for the same strokes via endless chains 36 (transmission train or drive).

Alternatively, a separate drive 20 e.g. a hydraulic motor or an electric gear motor, could be provided for each screw spindle 32 or for each screw spindle device 30, 31.

The lateral inclination adjustment assembly Q is arranged in the frame A2 and includes a remotely actuable actuator 22 (e.g. a hydraulic motor, hydraulic cylinder or an electric motor) which e.g. (schematically indicated in FIG. 2) is connected with at least one support 47 at the sole plate 2 of the extension screed A. The actuator 22 drives e.g. via an angular transmission or a worm transmission or a worm drive 27 at least one vertical screw spindle 23. Alternatively, several actuators 22 or screw spindles 23 could be provided in travelling direction R behind each other and with a distance in-between. The actuator 22 even may be a hydraulic cylinder which is coupled either via a link assembly with the support or the supports 47, respectively, or is arranged vertically and is directly coupled with the support or the supports 47.

The sole plate 2 of the extension screed A can be pivoted by means of the actuator 22 about the hinge axis X of a pivot hinge 21 in the frame A2 in order to set the lateral inclination angle 39'. In the shown embodiment, in which the extension screed A is mounted at the rear side of the base screed G the hinge axis X is situated e.g. at the outer end region (close to the mounting plate 46 in FIG. 4) of the frame A2. The actuator 22 is mounted in the vicinity of the opposite end of the frame A2. The hinge axis X extends substantially parallel to the sole plate 2 of the extension screed A and parallel to the travelling direction R. Alternatively, the pivot hinge 21 may be placed at another location between the end regions of the frame A2.

Either an edger plate 48 or a screed extension part 49 may be mounted at the mounting plate 46 at the outer end of the frame A2. The edger plate 48 forms a sideward boundary of the poured paving material V. The screed extension part 49 allows to lay a paving mat with even larger working width. The dragging resistance of the paving material V imparts forces on the frame A2, in particular via the edger plate 48 and/or the screed extension part 49. These forces deviate the sole plate 2 of the extension screed A and are introduced along a force transmission path within the frame A2 and via the vertical guidances 33 and the adjustment assemblies 3 into the extension guiding structure A1.

Figure 5:
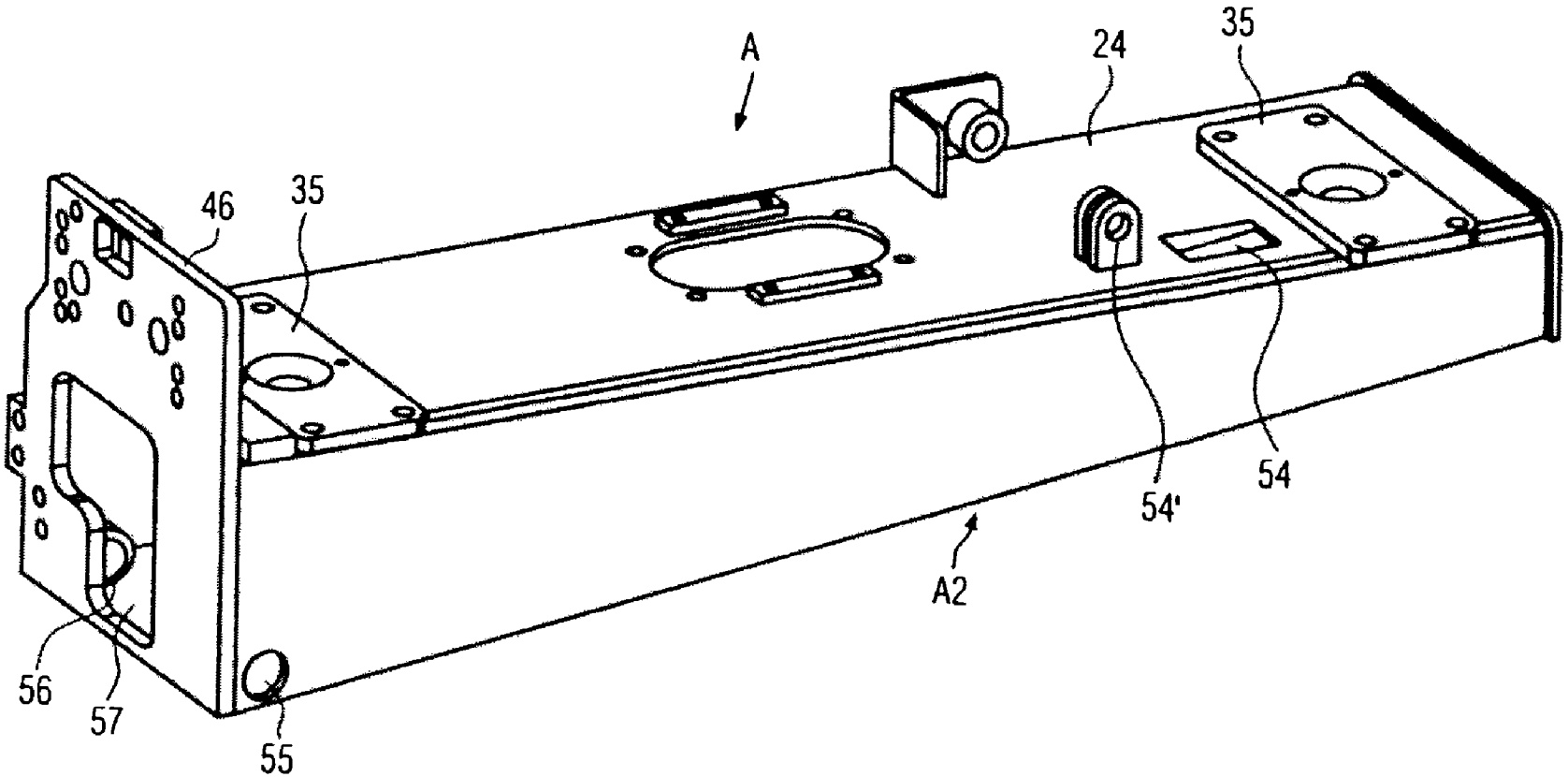
FIG. 5 is a perspective view of a frame of one extension screed.
Figure 6:
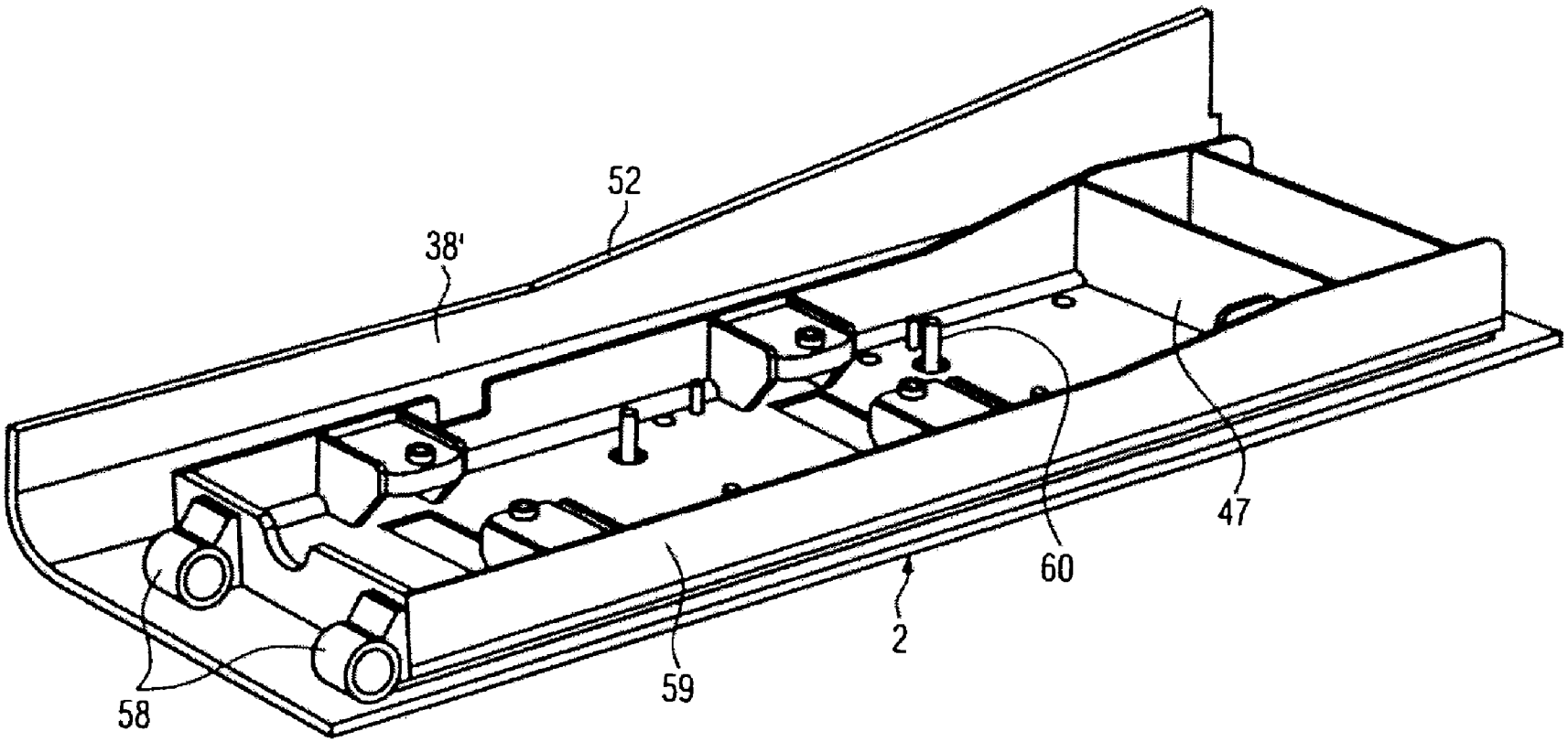
FIG. 6 is a perspective view of a sole plate of an extension screed.
Figure 7:
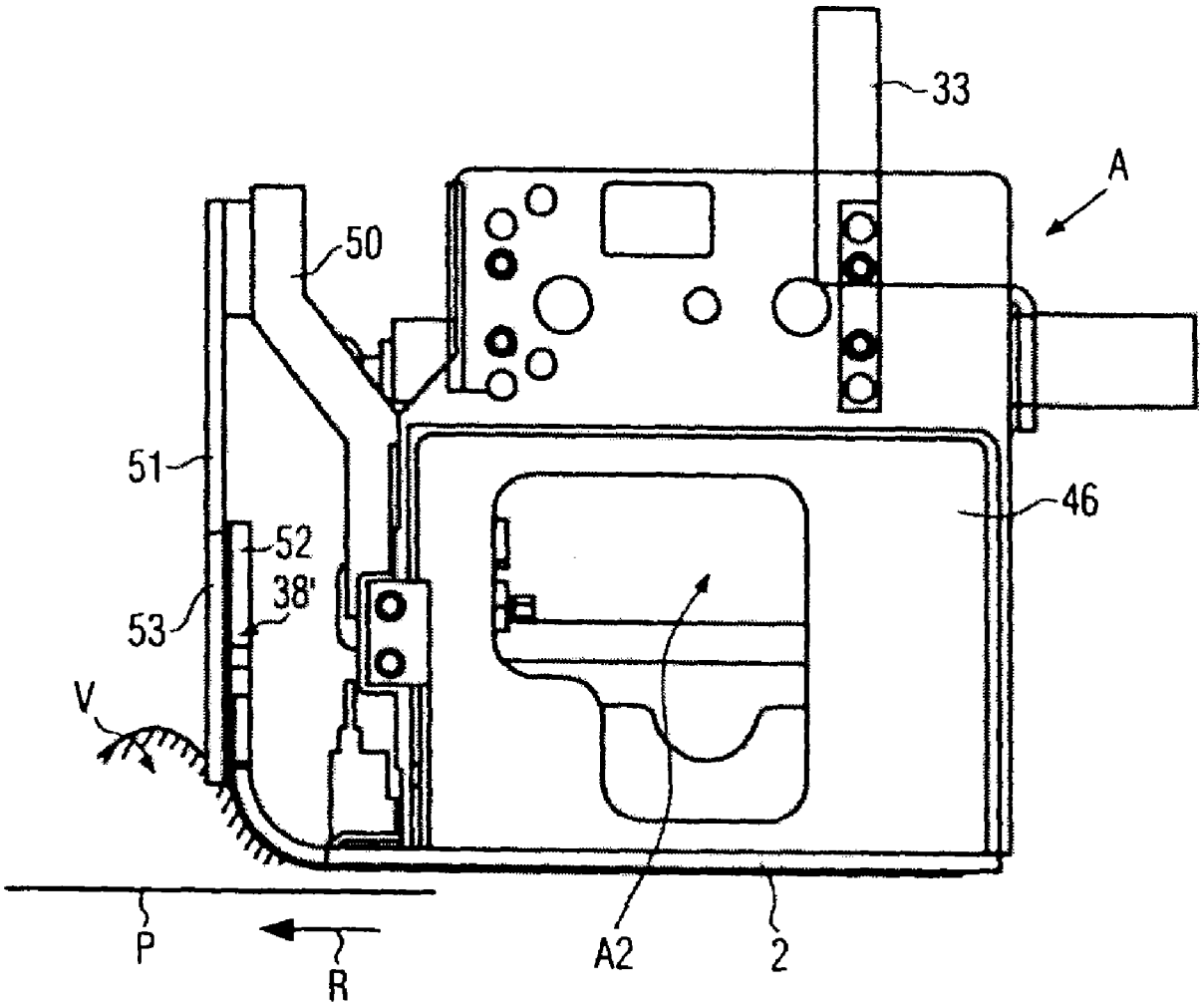
FIG. 7 is a top view of the outer end of the frame to which the sole plate of the extension screed is mounted.

The frame A2 of the extension screed A in FIGS. 5, 6, 7 has an inverted U-shaped cross-section and an open lower side 57 and carries the consoles 35 on the upper side 24. The upper side has an opening 54 and a support 55 for the actuator 22, 23. Bearing blocks 56 are arranged in the frame A2 behind the mounting plate 46 as parts of the pivot hinge 21. In the bearing blocks 56 a pin (not shown) may be mounted, e.g. through a frame aperture, which pin then will define the hinge axis X.

The sole plate 2 of the extension screed A has the shape of a planar plate and at a front side an upwardly bent skirt 38'. The sole plate 2 carries a trough-shaped carrying frame 59 (which is welded on and/or fixed by threaded connections) carrying bearing blocks 58 as further parts of the pivot hinge 21. The carrying frame 59, furthermore, has the support 47 for the actuator 22. The skirt 38' has an upper edge 52 which first extends parallel to the sole plate 2 and then extends in a further portion obliquely upwards. A front wall 51 is mounted at brackets 50 on the frame A2. The front wall 51 extends downwardly to an inclined lower edge 53 and overlaps the skirt 38 (in travelling direction R in front of the skirt 38') in order to take up forces from the paving material V and to shield a marked part of the skirt 38'.

In a not shown alternative of the paving screed E (front mount version) each extension screed A may be mounted at the front side of the base screed G by means of a guidance F fixed in the base screed and of an extension guiding structure A1 analogous to FIGS. 2 to 4.

In this case the hinge axis X or the pivot hinge 21 may be positioned close to the inner end region of the frame A2 or even somewhere between the end regions of the frame A2. In this case the actuator 22 e.g. can be positioned in the vicinity of the outer end region of the frame A2.

The height of the frame A2 gradually decreases e.g. corresponding to the maximum lateral inclination angle 39, 39' of the sole plate 2 of the extension screed A. The rear lower end edge of the sole plate 2 is shown in FIG. 3 in the case of a maximum lateral inclination at 2E, and in straight alignment of the sole plate 1 of the base screed G or the rear lower end edge 1E of the sole plate 1 at 2E' (to form a planar lane 45).

FIG. 2 shows the transition 19' between the lane 45 and the slope 44. The lateral position of the transition 19' is defined by the theoretical point of intersection 19 between the rear lower end edge 2A of the laterally inclined sole plate 2 of the extension screed A and the rear lower end edge 1E of the sole plate 1 of the base screed G. The point of intersection 19 or the transition 19' has to be held stationarily with respect to the base screed G when the working width of the paving screed E is varied so that the width of the lane 45 then does not vary. This is achieved by an actuation of the adjustment assemblies 3 exclusively without actuating the lateral inclination adjustment assembly Q.

A lateral inclination measuring device 42 (e.g. an angle sensor, e.g. in the frame A2) and/or a height measuring device (not shown) for detecting the relative height difference between the rear lower end edge 2A of the sole plate 2 of the extension screed A and the rear lower end edge 1E of the sole plate 1 of the base screed G and/or a linear travel measuring device at or within the actuator 22 may be provided in the paving screed E or in the extension screed A (FIG. 2). The respective measuring device, as listed above, may be in signal transmitting connection with a superimposed control device C and delivers information e.g. on the lateral inclination or the like. Furthermore, an angle sensor 48 may be connected to the control device C for transmitting information on the angle of attack $\alpha$ of the paving screed E, and/or a travelling measuring device, e.g. of the drive 14, for transmitting information on the retraction or extension or the sliding position of the extension screed A relative to the base screed G. The control device C in turn can be connected to transmit command signals to the adjustment assemblies 3 and optionally even to the lateral inclination adjustment assembly Q in order to synchronously actuate the adjustment assemblies 3 so that the point of intersection 19 or the transition 19' is held stationary with respect to the base screed G when the laying conditions are varied (e.g. in case of a variation of the working width). This can be carried out in an automatic or semi-automatic control process.

In the embodiment of the paving screed E in FIGS. 2 to 4, having the extension screeds A mounted to the rear side of the base screed G, the point of intersection 19 permanently should remain at the outer lower end of the rear edge of the sole plate 2 of the base screed G. In case of a paving screed E having the extension screed A mounted at the front side of the base screed G, however, the point of intersection 19 may be positioned in relation to the outmost end point of the rear lower edge of the sole plate 1 of the base screed G further inward but should even then be held stationary by a corresponding actuation of the adjustment assemblies 3 when the working width is varied.

If in FIG. 1 the angle of attack $\alpha$ is reduced, the extension screed A and consequently the inner end point of the lower edge of the sole plate 2 of the extension screed A would be lifted relative to the rear lower end edge of the sole plate 1 of the base screed G, because the base screed G tends to rotate about the front edge of the sole plate 1. The then lifted extension screed would produce a longitudinal step in the surface of the paving mat 43. In order to avoid a longitudinal step the frame A2 is then lowered via the adjustment assemblies 3 in the case of a decrease of the angle of attack α until the rear lower end edge of the sole plate 2 of the extension screed A lies at the elevation of the end edge of the sole plate 1 of the base screed G. Inversely, in case of a decrease of the angle of attack α the frame A2 is correspondingly lifted via the adjustment assemblies 3. If the extension screed A slides further to the right side in FIG. 2, and in case of a lateral inclination angle 39' set to a magnitude larger than zero degrees, simultaneously the frame A2 is lifted via the adjustment assemblies 3 so far that the point of intersection 19 remains stationary in lateral direction with respect to the base screed G. In the fully retracted position of the extension screed A in FIG. 4 the frame A2 is lifted via the adjustment assemblies 3 so far that in case of a laterally inclined sole plate 2 of the extension screed A the point of intersection 19 is positioned at the left side end of the sole plate 1 of the base screed G.

While laying a paving mat 43 with a slope 44 it is necessary to counter a drift from the point of intersection 19 with respect to the base screed G as rapidly as possible when the working width is varied. In the road paver RF (or in a not shown exterior control panel at the paving screed E) e.g. an actuation device with switches or buttons for actuating the control device C is provided. The buttons or switches may be manipulated one by one by the operator of the road paver or by personnel. The switch or button for controlling the actuator 22 could be blocked selectively. When releasing the function of this switch or button from a blocked condition the button or switch for controlling the adjustment assemblies 3 is coupled with the switch or button for retracting or extending the extension screed A such that when actuating the switch or button for extending or retracting the extension screed A the necessary height adaptation is executed automatically. With a given linear speed of the adjustment assemblies 3, expediently, the speed of the extension or retraction of the extension screed A should become correlated with the speed of the height adaptation such that the point of intersection 19 is held stationary. In other words, the respective lateral position of the point of intersection 19 first may be set for later regulating operations in the control device C. For such regulating operations also others method could be used, e.g. even a fully automatic regulating method.

The extension screed A in FIG. 4 is fully retracted. The outer cheek 29 of the extension screed A abuts from the outer side substantially at the outer cheek 16 of the base screed part G1. The guiding body 17, not shown in FIG. 4, has moved to the fixation 13 (positions 18R, 17R). The torque support 11 engages at the other end of the guiding rail 10. The sole plate 1 of the base screed G is positioned in travelling direction R ahead of the sole plate 2 of the extension screed A. The sole plate 2 of the extension screed is somewhat lifted at the inner end. The frame A2 is lifted via the adjustment assemblies 3 so high that in FIG. 4 the left side end of the rear lower edge 2E of the sole plate 2 of the extension screed A is placed at the elevation of the rear end edge 1E of the sole plate 1 of the base screed G, or even higher up. The telescopic tube arrangement is fully retracted. This may also be a position for transport travel of the road paver RF with completely lifted paving screed E which then has a transport width only corresponding to the width of the base screed G.

Figure 8:
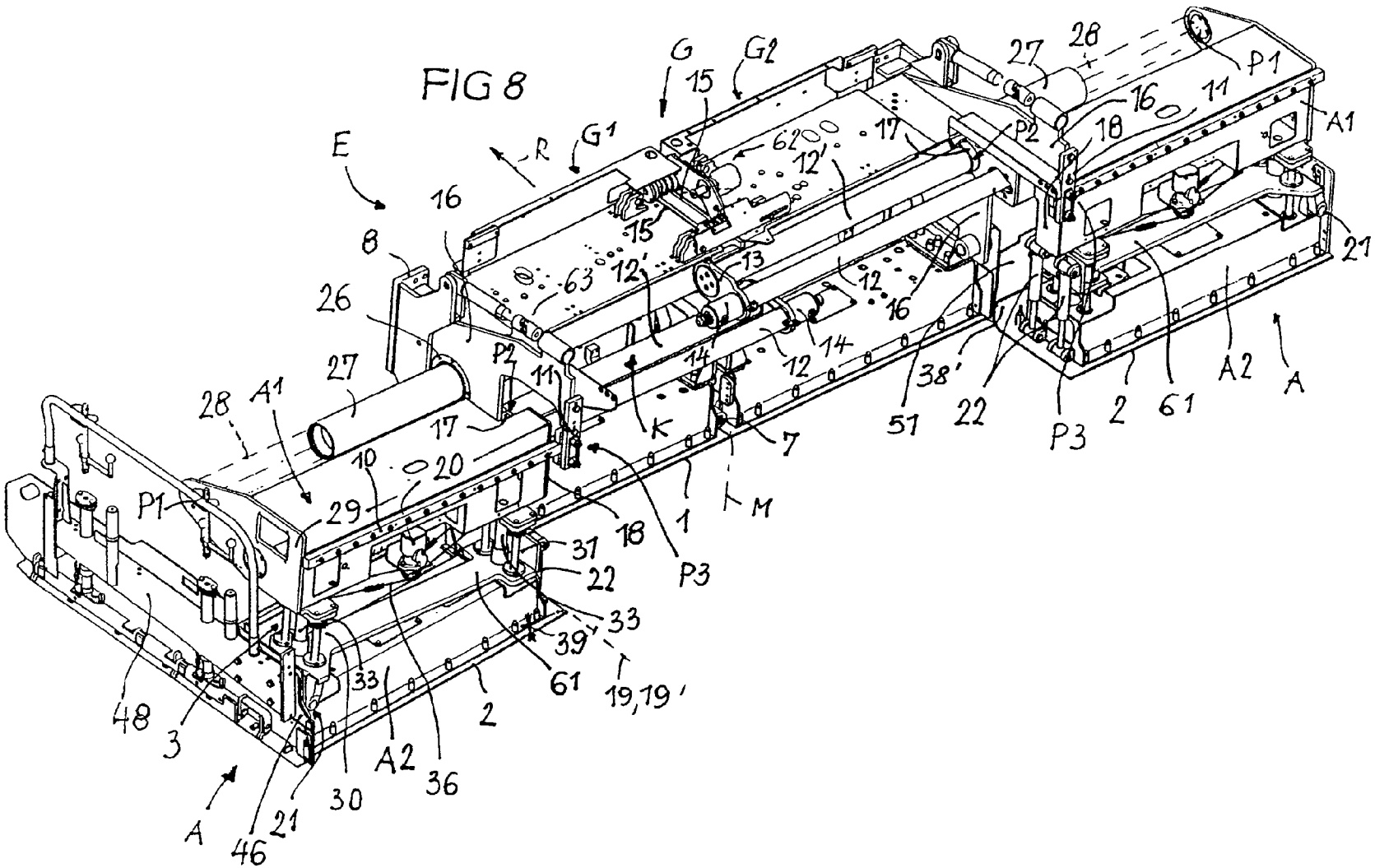
FIG. 8 is a perspective view of a second embodiment of the paving screed.

The further embodiment of the paving screed E shown in FIG. 8 differs from the embodiments of FIGS. 2 to 7 mainly in that for setting the lateral inclination angle 29' of the sole plate 2 of the extension screed A for forming the slope 44 the sole plate 2 of the extension screed A is not inclined laterally relative to the frame A2 in the pivot hinge 21, but that the sole plate 2 of the extension screed A is mounted fixed to the frame A2 (preferably such that it can be replaced). In this case the frame A2 will be inclined laterally together with the sole plate 2 of the extension screed A in the pivot hinge 21 by means of the actuator 22. Furthermore, the adjustment assemblies 3, 30, 31 of the extension screed A commonly engage at an intermediate frame 61 at which the pivot hinge 21 for the frame A2 is provided, and at which the actuators engage which are connected to the frame A2. The pivot hinge 21 and the actuators 22, respectively, are arranged close to the end regions of the frame A2, i.e. close to the outer and inner ends, with the adjustment assemblies 3, 30, 31 positioned in-between.

Both extension screeds A are maximally extended in FIG. 8. The left side extension screed A in FIG. 8 is adjusted for forming the slope 44 such that the sole plate 2 of the extension screed A obliquely ascends from the outer end in a direction towards the middle M of the base screed G with the lateral inclination angle 39'. The lateral position of the transition or point of intersection 19, 19' between the slope 44 and the lane 43 is at the outer end of the sole plate 1 of the base screed G.

A drive 20 which is common for both adjustment assemblies 3, 30, 31 of each extension screed A is mounted at the extension guiding structure A1. The drive 20 is in driving connection with the screw spindles of the adjustment assemblies 3, 30, 31 via chain drives or transmission trains 36.

The further structure of the paving screed E in FIG. 8 corresponds to the structure of the other embodiment of the paving screed E in FIGS. 2 to 7. The multiple points suspension K for the respective extension guiding structure A1 is a three point suspension having the first, second and third support points P1, P2, and P3. The first support point P1 is situated in the outer cheek of the extension guiding structure A1, and, in particular, at a location at which the telescope tube 28 is secured in the outer cheek 29. The second support point P2 is situated in the guiding body 17 which is secured at the inner cheek 18 of the extension guiding structure A1 and is slidably guided on the guiding rod or the guiding tube 12'. The guiding rod or guiding tube 12' is secured at the outer end in the outer cheek 16 of the base screed part G1 and extends with the inner end beyond the middle M of the base screed G into the other base screed part G2 to the fixation 13 which is placed there and is connected with the inner cheek 15 of the base screed part G1 such that the guiding body 17 can move from an outer position at the inner side of the outer cheek 16 of the base screed part G1 maximally into abutment at the fixation 13. The maximum stroke of the extension screed A corresponds substantially to half of the width of the base screed G. The third support point P3 is defined by the torque support 11 mounted at the outer cheek of the base screed G and the guiding rail 10 mounted at the rear side of the extension guiding structure A2 and by the engagement between the guiding rail 10 and the torque support 11. The first and second support points P1, P2 follow the retraction or extension of the extension screed A. The third support point P3 remains stationary with respect to the base screed G. The guiding tube 12' is offset in travelling direction R from the telescopic tube arrangement with an outer telescope tube 26 extending between the inner and outer cheeks 16, 15 of the base screed part G1, the intermediate telescope tube 27 and the telescope tube 28. The guiding tubes 12' in both base screed parts G1, G2 also offset in relation to each other in travelling direction R, as well as the drives 14, 12, i.e. the hydraulic cylinders which extend through corresponding cut-outs in the outer cheeks 16 and engage at the extension guiding structure A1.

The edger plate 48 is mounted at the mounting plate 46 in FIG. 8 and hinders during laying the paving mat that the paving material V may flow sidewardly out of the set working width. Instead of the edger plate 48 a not shown screed extension part may be mounted at the mounting plate 46. The respective screed extension part defining the outermost end of the paving screed E then also carries an edger plate 48.

In FIG. 8 both base screed parts G1, G2 are aligned with each other (planar lane 43). However, the base screed parts G1, G2 may be tilted from the aligned position shown in FIG. 8 about the joint 7 in relation to each other to form an obtuse angle and to form a crown profile in the lane 43. For this purpose a device 62 may be provided in the base screed G. Furthermore, this embodiment has a device 63 between the base screed G and each connection 8 for a towing bar not shown in FIG. 8 in order to vary the angle of attack $\alpha$ of the paving screed A relative to the towing bar or the connection 8 without the necessity of adjusting the elevation of the towing points 5 at the road paver RF.

The embodiment in FIG. 8 could be equipped with a statically defined three point suspension of the extension guiding structure A1, as explained for the preceding embodiments. In this case a guiding body not shown in FIG. 8 is slidably guided on the outer telescope tube 26 of the telescopic tube arrangement, instead of the guiding body 17 at the inner cheek 18 of the extension guiding structure A1. In this case the first and second support points P1, P2 could be situated in the axis of the telescopic tube arrangement. However, then the possible stroke of the extension screed A would be somewhat shorter than with the three point suspension shown in FIG. 8.

The lateral position of the transition or point of intersection 19, 19' is held stationary with respect to the base screed G, if the working width is varied, by actuating the adjustment assemblies 3, 30, 31 matched with the retraction or extension (drive 14, 12). The intermediate frame 61 is lifted while the extension screed A is retracted. The intermediate frame 61 is lowered while the extension screed A is extended.

The invention claimed is:

1. Paving screed for road pavers, comprising:

a base screed and extension screeds each being supported by a guiding assembly having an extension guiding structure on a guiding arrangement located on the base screed, extension screeds being arranged at the front side or the rear side of the base screed and being slidably retractable and extendable in a direction parallel to the base screed, sole plates on the lower sides of the base screed and the extension screeds, towing bars on the base screed for floatingly towing the paving screed at an angle of attack ($\alpha$) of the sole plates relative to a planum, a multiple point suspension on the guiding assemblies and located between the extension guiding structure and the base screed, a frame in the extension screed carrying the sole plate of the extension screed, at least two substantially vertical adjustment assemblies, spaced apart in the sliding direction of the extension screeds, the adjustment assemblies being activated by at least one drive, and engaging at the extension guiding structure for adjusting at least the height of the frame and the sole plate of the extension screed relative to the base screed, a lateral inclination adjustment assembly having at least one remotely controlled drive, and structurally separated from the adjustment assemblies, including a pivot hinge having a hinge axis oriented at least substantially perpendicular to the sliding direction and parallel to the sole plate of the extension screed, wherein the adjustment assemblies are positioned between the extension guiding structure and the frame of the extension screed, and the lateral inclination adjustment assembly is located between (i) the adjustment assemblies and the frame to which the sole plate of the extension screed is fixed, or (ii) between the frame to which the sole plate of the extension screed is mounted and the sole plate of the extension screed.

2. The paving screed of claim 1, wherein the pivot hinge of the lateral inclination adjustment assembly is located either (i) between the sole plate of the extension screed and the frame or, (ii) between an intermediate frame and the frame, the intermediate frame interconnecting lower actuation end points of the adjustment assemblies, and at least one actuator is moveable in a sliding direction from the pivot hinge, the actuator being located between the frame and the sole plate of the extension screed, or between the frame and the intermediate frame, respectively.

3. The paving screed of claim 1, wherein the sole plate of the extension screed is formed as a planar plate having a skirt at the front of a longitudinal side and a front wall mounted to the frame at the front side, and extending downwardly beyond the front of the skirt of the sole plate of the extension screed.

4. The paving screed of claim 1, wherein a carrying frame is positioned on the sole plate of the extension screed, the carrying frame comprising a part of the pivot hinge and at least one support for a remotely controlled drive, and the frame also carries further parts of the pivot hinge and a support for the drive.

5. The paving screed of claim 1, wherein the hinge axis is defined by at least one pin inserted in aligned parts of the pivot hinge.

6. The paving screed of claim 1, wherein a mounting plate for an edger plate or a screed extension part is located at an outer end of the frame.

7. The paving screed of claim 2, wherein the pivot hinge is located in the extension screed at the inward or outward end portion of the frame, and the extension screed mounted at the rear side of the base screed and the actuator being arranged in an end region of the frame facing to the middle of the base screed and the pivot hinge being located in the outer end region of the frame remote from the middle of the base screed.

8. The paving screed of claim 2, wherein the actuator comprises at least one hydrocylinder oriented substantially vertical to the sliding direction.

9. The paving screed of claim 2, wherein vertical guidances are positioned between the extension guiding structure and either the frame or the intermediate frame, the vertical guidances, being functionally associated with the adjustment assemblies.

10. The paving screed of claim 3, wherein the lower side of the frame and an upper edge of the skirt of the sole plate of the extension screed are moveable obliquely towards the middle of the base screed.

11. The paving screed of claim 1, wherein the paving screed is supported by the adjustment assemblies at a jam-free operating three point suspension having three support points, and wherein the three point suspension of the extension guiding structure has (i) a first support point at an outer cheek outside of the base screed at a telescope tube which can be extracted and retracted relative to the telescopic tube arrangement of the guiding assembly fixed in the base screed, (ii) a second support point coaxial to the first support point at an inner cheek within the base screed in a guiding body guided on the telescope tube, and (iii) a third support point on a guiding rail extending from the rear side and distant from the guiding assembly at the extension guiding structure in sliding direction in a torque support fixed to the base screed, such that the inner cheek of the maximally retracted extension screed is moved on the telescopic tube arrangement to an inner cheek of the base screed, with the third support point being offset in a side view of the extension screed in relation to the coaxial first and second support points.

12. The paving screed of claim 1, wherein the extension screed is supported by the adjustment assemblies at the multiple point suspension, the extension guiding structure has in the multiple point suspension the first support point at an outer cheek outside of the base screed at a telescope tube which is extendible and retractable in a telescopic tube arrangement of the guiding assembly fixed at the base screed, the second support point located at a guiding body at an inner cheek of the extension screed within the base screed, the guiding body being slidably guided on a guiding tube of the guiding assembly, the guiding tube extending parallel and with an offset perpendicular to the sliding direction to the telescopic tube arrangement and being fixed in the base screed, and the third support point located at a guiding rail extending in sliding direction and being fixed at the rear side of the extension guiding structure, the guiding rail engaging into a torque support fixed to the base screed, the guiding tube being secured at an inner end in the base screed in a fixation which is offset from the side of the extension screed beyond the middle of the base screed to the opposite side of the middle such that the guiding body of the maximally retracted extension screed is moved on the guiding tube beyond the middle substantially to a location close to the fixation at the opposite side of the middle.

13. The paving screed of claim 2, wherein a lateral inclination measuring device and/or a device for measuring the relative height difference between the sole plate of the extension screed and the sole plate of the base screed is located within or on the actuator and is connected in signal transmitting fashion with a paving screed functions control device.

14. The paving screed of claim 1, wherein the adjustment assemblies are formed as screw spindles, of the extension screed and have a common drive, arranged substantially centrally between the adjustment assemblies on the frame or the intermediate frame, the drive being connected for a synchronous actuation of the adjustment assemblies with the adjustment assemblies via transmission trains and/or drive trains.

15. A method for laying a paving mat having a lane and at least one laterally inclined, sideward slope with varying working width on a planum with a paving screed comprising forming the slope outside of a transition from the lane into the slope with a base screed having a sole plate and at least one extension screed with a sole plate located at a frame, verifying the working width of the lane with extending or retracting the extension screed relative to the base screed at the front side or the rear side of the base screed retracting and extending an extension guiding structure in lateral direction at a guidance structure having several guiding assemblies, the guidance structure being fixed to the base screed, the paving screed having at last two adjustment assemblies per extension screed spaced apart in sliding direction and engaging at the extension guiding structure for adjusting the height position of the sole plate of the extension screed relative to the sole plate of the base screed and a lateral inclination adjustment assembly of the extension screed for forming the slope, the lateral inclination adjustment assembly being structurally and functionally separated from the adjustment assemblies and arranged for adjusting a lateral inclination angle and the method comprising the following steps:

adjusting the lateral inclination angle of the sole plate of the extension screed relative to the extension guiding structure at the frame, and holding the previously set lateral position of the transition between the lane and the slope stationary with respect to the base screed when the working width of the paving mat is varied by extending or retracting the extension screed and simultaneously adjusting the height position of the sole plate of the extension screed relative to the extension guiding structure.

* * * * *